United States Patent [19]

Campbell

[11] 4,045,303

[45] Aug. 30, 1977

[54] PROCESS OF ELECTROPLATING POROUS SUBSTRATES

[75] Inventor: Barrie C. Campbell, Orem, Utah

[73] Assignee: Billings Energy Corporation, Provo, Utah

[21] Appl. No.: 711,772

[22] Filed: Aug. 5, 1976

[51] Int. Cl.[2] ..... C25D 7/00; C25D 7/04

[52] U.S. Cl. ..... 204/24; 204/277

[58] Field of Search ..... 204/24, 11, 21, 277, 204/284

[56] References Cited

U.S. PATENT DOCUMENTS

| | | | |
|---|---|---|---|
| 3,480,530 | 11/1969 | Voorhies | 204/129.7 |
| 3,616,286 | 10/1971 | Aylward et al. | 204/24 |
| 3,694,325 | 9/1972 | Katz et al. | 204/11 |

*Primary Examiner*—T. M. Tufariello

*Attorney, Agent, or Firm*—Criddle, Thorpe & Western

[57] ABSTRACT

A method of electroplating porous substrates includes the steps of disposing a porous substrate to be electroplated in an electrolyte solution, disposing an anode in the solution spaced apart from the substrate, with the anode being composed of the material to be deposited on the substrate, applying a gas to the substrate to flow therethrough, and applying a positive voltage to the anode and a negative voltage to the substrate while gas is flowing through the substrate.

11 Claims, 1 Drawing Figure

PROCESS OF ELECTROPLATING POROUS SUBSTRATES

BACKGROUND OF THE INVENTION

This invention relates to a process of electroplating substrates and more particularly to a process of electroplating porous substrates so that the pores of the substrates remain open and unclogged.

Electroplating is a well known technique of depositing metal or alloy from a suitable electrolyte solution onto an electrically conducting article. More generally, the article is connected to a negative current source so as to act as the cathode in the electrolyte solution. Hydrated positive metal or alloy ions which are dissolved or complexed in the solution are attracted to the cathode by the negative current along electrostatic lines of force present in the solution. As the ion approaches the vicinity of the cathode, it progressively sheds the hydration envelope and becomes associated with the delocalized charge on the article. At the same time, the ion crosses the so-called "double layer" and loses some of its effective charge to become a partially neutral atom or adion, which is then deposited on the surface of the article. The adion then diffuses along this surface to a nearby lattice growth plane, where it becomes permanently fixed in position.

Lattice growth planes are determined by the submicroscopic morphology of the article and its plating history. As the metallic coating builds up, the adion gradually proceeds to a state of full dehydration and complete incorporation into the crystal structure now coating the surface of the article. The plating process may be halted at any time to provide a coating of any desired thickness. An anode consisting of the metal or alloy to be deposited and immersed in the electrolyte solution may be used to provide replacement ions for those depleted from the electrolyte through a similar, though reversed, process. The current supplied by the external source provides the necessary electron transfer to create and subsequently discharge the metal or alloy ions.

The electroplating process has proved very advantageous in depositing very thin and uniform layers or metal or alloy onto substrates. However, it is apparent that if this process were directly applied to depositing material onto a porous substrate, the material to be deposited could, depending upon the electroplating time, clog the pores of the substrate. For certain uses of such plated porous substrates, this would be undesirable. For example, if the porous substrate were to be used as an electrode in an electrolysis process, it may be important that fluid communication through the substrate be maintained and, of course, if the pores were clogged, this would not be possible. As another example, if the porous substrate were to be used as a filter in a corrosive environment, it would be desirable to plate the substrate with protective material while maintaining the porosity of the substrate.

SUMMARY OF THE INVENTION

It is an object of the present invention to provide a new and useful method of electroplating porous substrates without clogging the openings or pores of the substrates.

This and other objects of the invention are realized in an exemplary process which includes placing a porous substrate to be plated into an electrolyte solution, placing an electrode into the solution where the electrode may be composed of the material to be deposited onto the substrate, forcing gas through the substrate, and then applying an electric current to the substrate and to the electrode while gas is being forced through the substrate. With this process, the pores of the substrate are maintained free of the material being deposited by action of the gas flowing through the pores. It has been found that forcing the gas upwardly through the substrate provides a relatively uniform flow of the gas which, in turn, operates to more uniformly maintain the pores free from clogging. It has also been found that by positioning the electrode directly above the substrate that the material is deposited more uniformly on the surface of the substrate.

BRIEF DESCRIPTION OF THE DRAWING

The above and other objects, features and advantages of the present invention will become apparent from a consideration of the following detailed description presented in connection with the accompanying drawing which diagrammatically shows the configuration of materials and equipment used in practicing the present invention.

DETAILED DESCRIPTION

Figure 1:
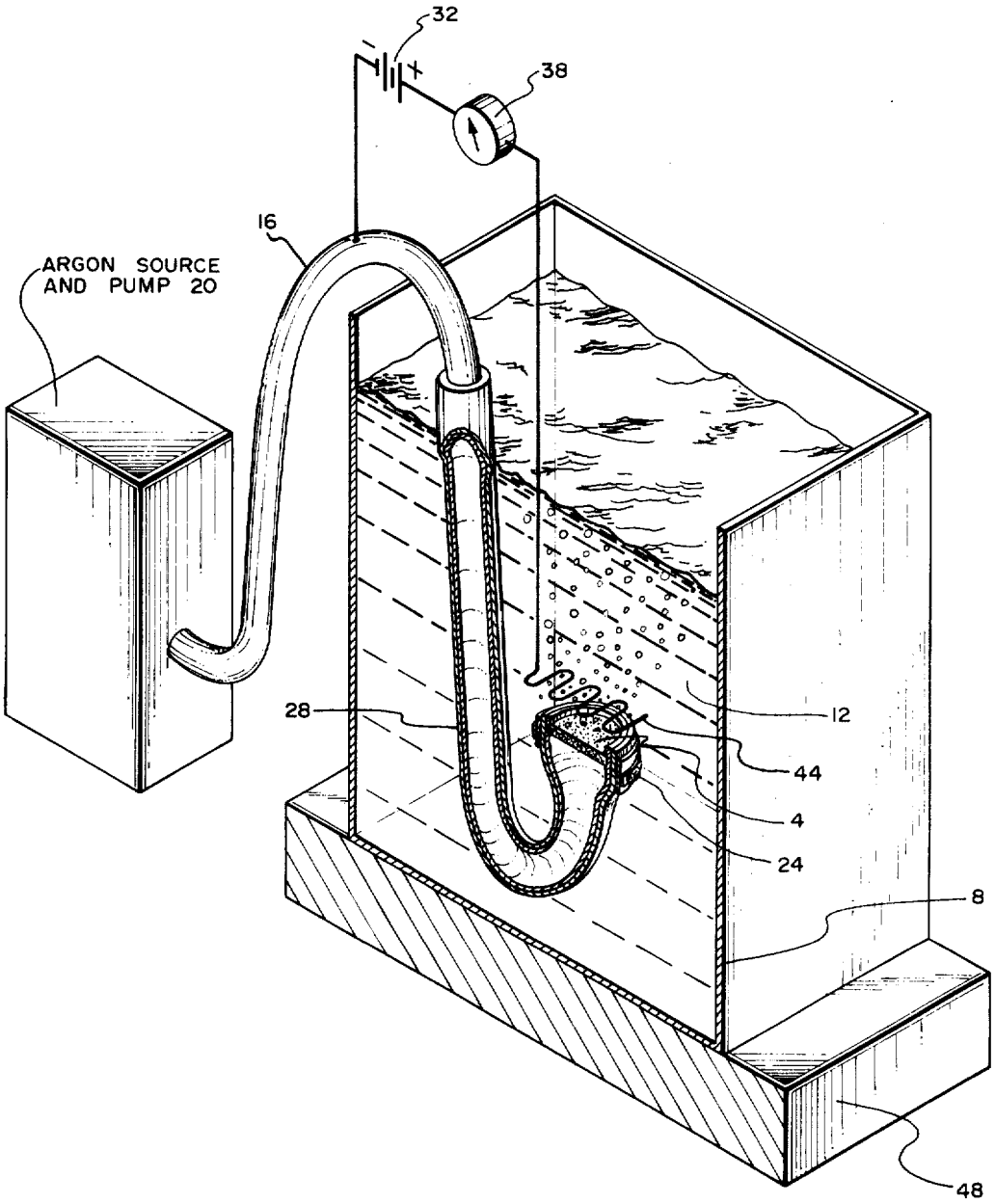

Referring to the drawing there is shown an illustrative configuration of the elements used in carrying out the present invention. The configuration shown is adapted to electroplate a porous sintered nickel substrate or disc 4 with copper.

A container 8 holds a copper sulphate solution. This solution might illustratively be prepared from 2.5 grams of hydrated copper sulphate, 3 milliliters of 6 molar nitric acid and 4 milliliters of 9 molar sulphuric acid for every 100 milliliters of water. Of course, other electrolyte solutions containing copper could be utilized.

The sintered nickel substrate 4 is disposed in the end of a tube 16 which is immersed in the solution 12. The end of the tube containing the substrate 4 flares outwardly in a bell shape to accommodate the substrate. The other end of the tube 16 is coupled to an argon gas source and pump 20. The substrate 4 is held tightly in place in the end of the tube 16 by a suitable hose clamp 24. The tube 16 is composed of electrically conductive material such as stainless steel, steel titanium or aluminum. Advantageously, the material of which the tube 16 is composed would be less reactive than the substrate 4. To inhibit reaction of the tube 16 with the solution 12, an insulating layer of material 28 is wrapped about that portion of the tube immersed in the solution. Any suitable waterproof insulation material should suffice including common electrician's tape.

The tubing 16 is electrically coupled to the negative terminal of a battery 32 as generally indicated in the drawing. The positive terminal of the battery 32 is coupled to an ammeter 38. The ammeter 38 is coupled to a copper anode 44 which is formed into a generally flat grid as indicated in the drawing. The grid portion of the anode 44 is positioned directly above the substrate 4 and in such a manner that the plane of the grid is generally parallel with the plane of the substrate. The reason for this is to insure a more uniform exposure of the substrate 4 to the anode 44 and thus a more uniform deposition of copper on the substrate.

The container 8 is placed on a magnetic stirrer 48 so that the solution 12 will be stirred during the electroplating process. Provision of such stirring is a well known technique for maintaining a fairly uniform concentration of electrolyte components.

With the configuration shown in the drawing, application of current to the copper anode 44 causes the production of positive copper ions which are then attracted to the substrate 4. At the surface of the substrate, the copper ions combine with two electrons and then bond to the substrate. While this process is proceeding, argon or other inert gas is supplied by the tubing 16 to flow upwardly through the substrate 4 to maintain the pores of the substrate free from clogging. By forcing the argon gas upwardly through the substrate 4, the gas is forced to move fairly uniformly through all parts of the substrate. This may be contrasted, for example, with a vertical orientation of the substrate in which argon gas were forced horizontally through the substrate. In such a case, it can be appreciated that the gas would tend to move more readily and in a greater concentration through the top portion of the substrate rather than the bottom portion thereof simply because of the tendency of gas to rise in the solution 12. This problem is obviated with the orientation shown in the drawing.

An alternative orientation of the substrate 4 and tubing 16 would be to direct the argon gas downwardly through the substrate but then, the gas may tend to rise back up toward the substrate following its passage therethrough. The orientation shown in the drawing is thus a cleaner arrangement and is therefore the preferred arrangement.

The following example provides an illustration of the process of the present invention:

EXAMPLE

A number 10 gauge copper wire anode and a sintered nickel substrate cathode having a pore size of about 40 microns were immersed in a copper sulphate electrolyte solution composed of 25.2 grams of copper sulphate, 1000 milliliters of water, 10 milliliters of 36 molar sulphuric acid and 11.25 milliliters of 16 molar nitric acid. The sintered nickel substrate was disposed in the flared end of a copper tube and held in place in the end of the tube by a hose clamp. The surface of that portion of the tube immersed in the solution was wrapped with electrician's tape to minimize the exposure of the tubing to the solution. The sintered nickel substrate was generally circular in shape, having a 0.16 cm thickness and a 2.5 cm diameter. Except for that end of the copper tubing in which the sintered substrate was situated, the tubing had about a ¼ inch (0.63 cm) outside diameter. A 1 amp direct current was applied to the cathode and anode for a period of 2 hours while argon gas was bubbled through the sintered nickel substrate at a rate of about 2.0 liters/min. This resulted in a fairly uniform deposition of 0.77 gm of copper of about 170 microns thickness on the sintered nickel substrate, with the pores of the substrate remaining unclogged.

It is to be understood that the above-described arrangement is only illustrative of the application of the principles of the present invention. Numerous modifications and alternative arrangements may be devised by those skilled in the art without departing from the spirit and scope of the present invention and the appended claims are intended to cover such modifications and arrangements. For example, although the process of the present invention has been described as utilizing an anode composed of the material to be deposited on the substrate, this provision is not essential. Alternatively, an inert or insoluable anode (such as platinum) may be used which, of course, would result in a gradual depletion of the metal ions in the electrolyte solution as the process were carried out.

What is claimed is:

1. A method of electroplating porous substrates comprising placing a porous substrate in an electrolyte solution which includes ions of the material to be deposited on the substrate, forcing a gas through the porous substrate from the bottom side upwardly, and applying an electric current to the substrate and electrode while gas is being forced through the substrate.

2. A method as in claim 1 wherein said electrode is composed of the material to be deposited onto the substrate.

3. A method as in claim 1 wherein the substrate is fitted into one end of a tube for placement into the solution, and wherein the gas is applied to the other end of the flow through the tube and through the substrate.

4. A method as in claim 3 wherein gas in forced through said substrate at a rate sufficient to prevent solution from flowing through the substrate into the tube.

5. A method as in claim 3 wherein said tube is composed of electrically conductive material, and wherein the electric current is applied to the tube to flow to the substrate.

6. A method as in claim 1 wherein the gas forced through the substrate is an inert gas.

7. A method of electroplating porous substrates comprising disposing a porous substrate to be electroplated in an electrolyte solution which comprises ions of the material to be deposited onto the substrate, disposing an anode in the solution spaced from the substrate, applying a gas to the substrate to flow therethrough, and applying a positive voltage to said anode and a negative voltage to said substrate while gas is being applied to said substrate.

8. A method as in claim 7 wherein said anode is composed of the material to be deposited onto the substrate.

9. A method as in claim 7 wherein said gas is applied to the underneath side of said substrate to flow upwardly therethrough.

10. A method as in claim 9 wherein said substrate has a generally planar profile with one surface thereof facing generally upwardly, and wherein said anode is spaced above the substrate in a direction normal to the upper surface of the substrate.

11. A method as in claim 8 wherein inert gas is applied to said substrate.

* * * * *